US010156110B2

(12) United States Patent
Lin

(10) Patent No.: US 10,156,110 B2
(45) Date of Patent: Dec. 18, 2018

(54) JET CUTTER HAVING A TRUNCATED LINER AT APEX

(71) Applicant: HALLIBURTON ENERGY SERVICES, INC., Houston, TX (US)

(72) Inventor: Steve S. Lin, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/434,477

(22) PCT Filed: Apr. 23, 2014

(86) PCT No.: PCT/US2014/035184

§ 371 (c)(1),
(2) Date: Apr. 9, 2015

(87) PCT Pub. No.: WO2015/163872

PCT Pub. Date: Oct. 29, 2015

(65) Prior Publication Data

US 2017/0122082 A1 May 4, 2017

(51) Int. Cl.

| | |
|---|---|
| ***E21B 29/02*** | (2006.01) |
| ***B26D 3/16*** | (2006.01) |
| ***B26F 3/00*** | (2006.01) |
| ***E21B 29/00*** | (2006.01) |

(52) U.S. Cl.

CPC ..... *E21B 29/02* (2013.01); *B26D 3/16* (2013.01); *B26F 3/00* (2013.01); *E21B 29/00* (2013.01)

(58) Field of Classification Search

CPC ..... E21B 29/02; E21B 29/00; E21B 43/114; B26D 3/16; B26F 3/00; F42D 3/00; F42D 5/06

See application file for complete search history.

(56) References Cited

U.S. PATENT DOCUMENTS

| | | | | |
|---|---|---|---|---|
| 2,525,391 | A * | 10/1950 | Bates | E21B 29/00 166/223 |
| 4,703,802 | A | 11/1987 | Bryan et al. | |
| 4,799,829 | A | 1/1989 | Kenny | |
| 4,819,728 | A | 4/1989 | Lafitte | |
| 5,924,489 | A | 7/1999 | Hatcher | |
| 2009/0235836 | A1* | 9/2009 | Pratt | F42B 1/032 102/306 |
| 2012/0168226 | A1 | 7/2012 | Brooks et al. | |

* cited by examiner

*Primary Examiner* — Brad Harcourt
(74) *Attorney, Agent, or Firm* — McGuire Woods LLP

(57) ABSTRACT

A method of severing a tubing string of a well system comprising: positioning a jet cutter within the tubing string, wherein the jet cutter comprises: (A) a main explosive load, wherein upon detonation or deflagration of the main explosive load, a jet propagates radially outward in a circle from an apex of the main explosive load; and (B) a liner, wherein the liner is truncated at the apex, and wherein the amount of truncation is selected such that the jet has a greater tip velocity compared to a substantially identical jet cutter without the truncated liner; and causing the main explosive load to detonate or deflagrate, wherein the tubing string of the well system is severed due to the detonation or deflagration.

20 Claims, 3 Drawing Sheets

JET CUTTER HAVING A TRUNCATED LINER AT APEX

BACKGROUND

In order to produce oil or gas, a wellbore is typically drilled into a reservoir or adjacent to a reservoir, and one or more tubing strings are positioned within the wellbore. In certain instances, it may be necessary to cut through or sever a tubing string, such as when the tubing string becomes stuck within the wellbore. A jet cutter may be used to sever the tubing string to allow the removal of a portion of the tubing string. Typical jet cutters include explosive loads that are detonated to sever the tubing string. Certain jet cutters, however, do not release sufficient energy upon detonation, leading to an incomplete severance of the tubing string or swelling or flaring at the severance point that can make removal of the tubing string difficult.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
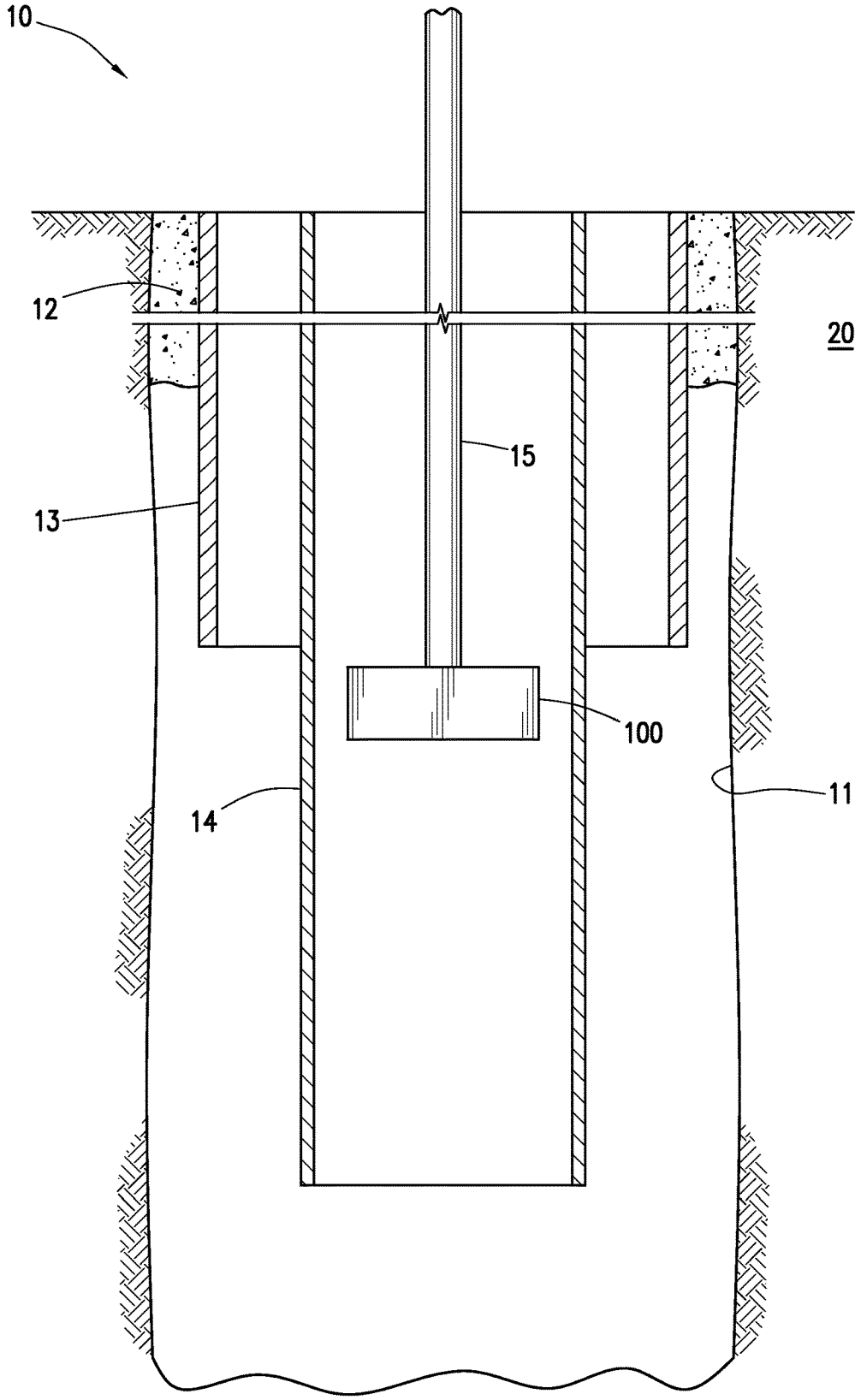
FIG. 1 is a schematic illustration of a well system including an example jet cutter according to certain embodiments.

As used herein, the words "comprise," "have," "include," and all grammatical variations thereof are each intended to have an open, non-limiting meaning that does not exclude additional elements or steps.

Tubing strings can be severed with a jet cutter. A jet cutter can be lowered into a wellbore inside of the tubing string to be severed. A jet cutter generally includes a retainer, a solid explosive load, a liner, an initiator, and a hollow cavity outside the liner. The retainer is circular in shape. The main explosive load tapers in from the top and bottom towards the middle to form an apex. The liner, being adjacent to the main explosive load, also tapers in and forms an apex. The circularity of the main explosive load and liner allows the entire inner diameter of the section of pipe of the tubing string to be contacted by the explosive forces. The retainer, explosive load, and liner can be part of a jet cutter cartridge that is located inside a housing. The liner forms a jet when the explosive charge is detonated. Upon initiation, a spherical wave propagates outward from the point of initiation along the axis of symmetry. This high-pressure wave moves at a very high velocity, typically around 8 kilometers per second (km/s). As the detonation wave engulfs the lined cavity, the liner material is accelerated under the high detonation pressure, collapsing the liner. During this process, for a typical conical liner, the liner material is driven to very violent distortions over very short time intervals (microseconds) at strain rates of 104 to 107/s. The collapse of the liner material on the centerline forces a portion of the liner to flow in the form of a jet where the jet tip velocity can travel in excess of 10 km/s. The jet tip velocity is the velocity at which the tip of the jet moves. The jet tip is the smallest part of the jet at the front of the jet and is different from the tail of the jet and the slug or carrot. The liner collapses progressively from the apex to the base under point initiation of the high explosive. A portion of the liner flows into a compact slug (sometimes called a carrot), which is the large massive portion at the rear of the jet.

The jet velocity decreases continuously from tip to tail. However, liner elements near the apex from one side of an axis of collision collide with corresponding liner elements from across the axis of collision with reduced final collapse velocity. The reduced collapse velocity results in slower jet speed and creates a logjam initially near the jet tip as successive elements near the apex region collide to a higher collapse velocity than the preceding elements. This phenomenon is called the inverse velocity gradient. This causes a decrease in overall velocity of the jet tip and decreases the overall energy of the jet. As a result, there may not be complete severance of the tubing string. Accordingly, the jet cutter may have to be repositioned to a different location within the tubing string, a different jet cutter may have to be used—each of which increases time and cost associated with the cutting operation. Another problem with a decrease in jet tip velocity and energy is swelling or flaring of the metal pipe during severance. Swelling or flaring can cause the edges near the cut to be rough or bend outward away from a longitudinal axis of the pipe. These roughened or flared edges can be very problematic when trying to remove the tubing string above the cut because the rough or flared edges can get caught on, or cause damage to, other wellbore equipment.

Previous attempts to solve the problem of an ineffective or undersized jet cutter is to increase the amount of explosive load within the jet cutter or to increase the outer diameter of the jet cutter housing. However, increasing the amount of explosive load may lead to an increase in swelling of the section of pipe being cut. Moreover, the inner diameter of the tubing string limits the outer diameter the jet cutter can have in order for the jet cutter to be positioned within the tubing string. Therefore, increasing the outer diameter of the jet cutter housing may not be possible.

Thus, there is a need for improved jet cutters. It has been discovered that the liner of a jet cutter can be truncated at and near the apex. The liner truncation can reduce or prevent an inverse velocity gradient during the collapse of the jet cutter liner from the detonation shockwave; thereby increasing the overall jet tip velocity and amount of energy produced. The increased velocity and energy will result in a more efficient and thorough cut of the section of pipe of the tubing string.

Turning to the Figures, FIG. 1 depicts a well system 10 containing a jet cutter 100. Oil and gas hydrocarbons are naturally occurring in some subterranean formations 20. In the oil and gas industry, a subterranean formation 20 containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore 11 is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore 11 can include vertical, inclined, and horizontal portions, and it can be straight, curved, or branched. As used herein, the term "wellbore" includes any cased, and any uncased, open-hole portion of the wellbore. The wellbore 11 can have a generally vertical cased or uncased section extending downwardly from a casing 13, as well as a generally horizontal cased or uncased section extending through the subterranean formation 20. The wellbore 11 can include only a generally vertical wellbore section or can include only a generally horizontal wellbore section. The wellbore 11 can be on-land or off-shore. A casing string 13 can be cemented into the wellbore with cement 12 to help stabilize the casing within the wellbore. A tubing string 14, such as a production tubing string, can also be run into the wellbore to perform wellbore operations or produce a reservoir fluid. A tubing string refers to multiple sections of pipe connected to each other. A tubing string is created by joining multiple sections of pipe together via joints.

It may be necessary to cut through or sever a tubing string 14 (including a casing string). One example of when it may be necessary to sever a tubing string is for pipe recovery operations. During pipe recovery operations, the entire circumference of the pipe section of the tubing string is completely severed such that the section of tubing string above the cut can be removed from the wellbore. The section of tubing string below the cut can either fall to the bottom of the wellbore, or if stuck or secured to the casing or wall of the wellbore via cement or packers, then it can remain in place.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen, packers, or other common components of a well system.

Figure 2:
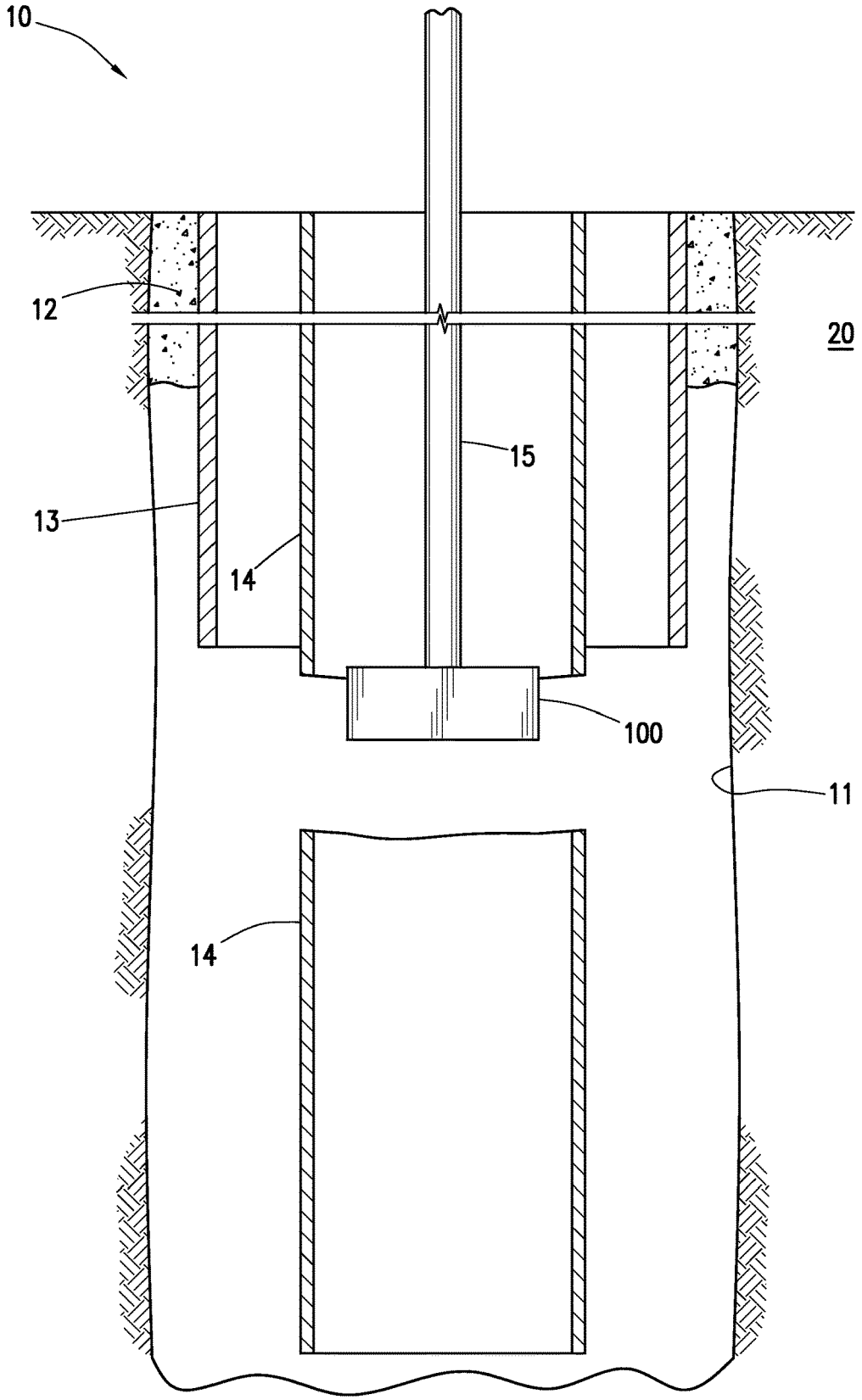
FIG. 2 is a schematic illustration of the well system of FIG. 1 after a tubing string has been severed with the jet cutter.

A tubing string 14 (such as a stimulation tubing string, production tubing string, or casing) can be installed in the wellbore 11. The jet cutter 100 is positioned within the tubing string 14. The jet cutter 100 can be positioned within the tubing string on a wireline or coiled tubing 15, for example. The jet cutter 100 can be positioned within the tubing string 14 at a desired location. According to one or more embodiments, the desired location can be the location at which the tubing string 14 is to be severed. By way of example, should the tubing string 14 become stuck within the wellbore 11, then the jet cutter 100 can be positioned at a location such that after severance, the top portion of the severed tubing string can be removed from the wellbore, for example as depicted in FIG. 2.

Figure 3:
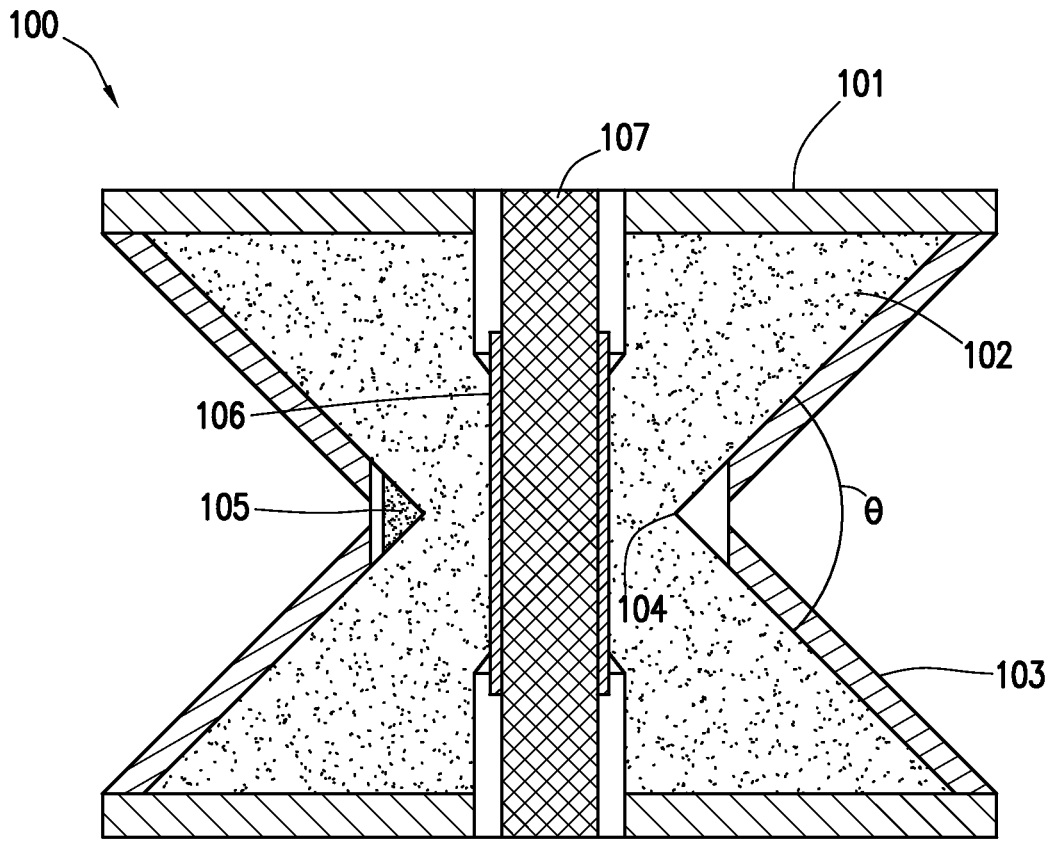
FIG. 3 is a diagram illustrating a jet cutter according to certain embodiments.

FIG. 3 depicts the jet cutter 100 according to certain embodiments. The jet cutter 100 includes a main explosive load 102. The main explosive load has an apex 104. The jet cutter 100 can further include a retainer 101, wherein the retainer 101 contains the main explosive load 102. The main explosive load 102 can be defined by the geometry of a housing (not shown) and the retainer 101. By way of example, the main explosive load 102 can have a circular top portion and bottom portion, and include flat surfaces that taper in at a convex angle to form a smaller middle diameter (i.e., the apex) than the diameters of the top portion and bottom portion. The amount of taper of the flat surfaces of the main explosive load 102 can form an angle θ. The retainer 101 can be made from a metal or metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. The metal or metal alloy of the retainer 101 can be selected from the group consisting of aluminum, zinc, magnesium, titanium, tantalum, and combinations thereof. The jet cutter 100 can also be a jet cutter cartridge that is located within a housing (not shown). The housing can be made from a variety of materials, including metals, metal alloys, and ceramic or any non-metallic materials with low debris characteristics.

The main explosive load 102 can include an explosive material. The explosive material can be selected from commercially-available materials. For example, the explosive material can be selected from the group consisting of [3-Nitrooxy-2,2-bis(nitrooxymethyl)propyl] nitrate "PETN"; 1,3,5-Trinitroperhydro-1,3,5-triazine "RDX"; Octahydro-1,3,5,7-tetranitro-1,3,5,7-tetrazocine "HMX"; 1,3,5-Trinitro-2-[2-(2,4,6-trinitrophenyl)ethenyl]benzene "HNS"; 2,6-bis,bis(picrylamino)-3,5-dinitropyridine "PYX"; 1,3,5-trinitro-2,4,6-tripicrylbenzene "BRX"; 2,2',2",4,4',4",6,6',6"-nonanitro-m-terphenyl "NONA"; and combinations thereof. The main explosive load 102 can further include a de-sensitizing material. The de-sensitizing material can be capable of binding the main explosive load 102 together. The de-sensitizing material can also help the main explosive load 102 retain its shape. The de-sensitizing material can be selected from the group consisting of a wax, graphite, plastics, thermoplastics, fluoropolymers (e.g., polytetrafluoroethylene), other non-energetic (inert) binders, and combinations thereof.

Upon detonation or deflagration of the main explosive load 102, a jet propagates radially outward in a circle from the apex 104. Detonation is an explosion at supersonic speeds that propagates via shock; whereas, deflagration is an explosion at subsonic speeds that propagates via heat. As used herein, the term "radially" means radiating from a common center along a radius. It is to be understood that the phrase "in a circle" is synonymous with 360°. As such, unlike a single-direction shaped charge, a jet cutter, when detonated, produces a high-pressure wave that moves in a circle 360° away from the apex. In other words, the high-pressure wave creates a jet that travels along most or every radii outwardly from the apex wherein each radius is substantially perpendicular to a longitudinal axis of the tubing string 14. In this manner, the jet cutter is able to create a complete cut through the wall of the tubing string around the entire circumference of the tubing string.

The jet cutter 100 further comprises a liner 103. The liner 103 is positioned adjacent to the main explosive load 102. For example, and as depicted in FIG. 3, the liner 103 can be positioned exterior to the main explosive load 102. The liner 103 is attached to the main explosive load 102 via a variety of mechanisms, whereby the main explosive load 102 forms a sealed chamber. The liner 103 also can take the geometric shape of the main explosive load 102. The liner 103 can be made from a variety of materials, including various metals and glass. Common metals include copper, aluminum, tungsten, tantalum, depleted uranium, lead, tin, cadmium, cobalt, magnesium, titanium, zinc, zirconium, molybdenum, beryllium, nickel, silver, gold, platinum, and pseudo-alloys of tungsten filler and copper binder.

As can be seen in FIG. 3, the liner 103 is truncated at the apex 104 of the main explosive load 102. The liner 103 is truncated where an apex of the liner would be if the liner were not truncated. The amount of truncation (i.e., the distance from the apex to where the liner begins) is selected such that the jet (created by the detonation or deflagration of the main explosive load) has a greater tip velocity compared to a substantially identical jet cutter without the truncated liner. According to another embodiment, the amount of truncation is selected such that an inverse velocity gradient is eliminated or substantially reduced. The jet tip velocity can be increased because the truncation of the liner at and near the apex removes liner elements with slower collision velocities that precede the faster moving elements in the jet tip. By removing these slower moving particles in the jet tip, the succeeding faster moving elements do not encounter additional disruptions due to collisions with the slower moving elements. The increase in the jet tip velocity can create a higher energy jet. According to another embodiment, the increase in the jet tip velocity decreases the amount of swelling or flaring of the tubing string 14 at the severance location.

The amount of increase in the jet tip velocity can vary and can depend on a variety of factors. A first factor is the geometry of the jet cutter 100 at the apex 104. For example, as the angle θ decreases, the amount of truncation of a solid metal liner may have to be increased and as the angle θ increases, the amount of truncation may be decreased (i.e., the angle and amount of truncation can be inversely correlated). This is because as the angle θ decreases, there is less distance between the two flat surfaces of the liner 103 that are tapering in towards the middle of the jet cutter, which in turn means that there might be a greater increase in collision of the collapsed liner materials. Thus, in order to decrease the amount of colliding materials, the amount of truncation can be increased. A second factor can include the material that the liner is made from (e.g., copper versus aluminum) and the explosive material that the main explosive load is made from (e.g., HMX versus RDX). For example, if a denser material, such as tantalum, compared to another metal such as copper, is used for the liner, then more of the liner may need to be truncated. This may be due to the heavier liner elements requiring more time to reach their final collapse velocity before colliding with other elements. A third factor can include the thickness of the liner. Liners generally have a thickness in the range of about 0.025 to about 0.250 inches. For example, as the liner thickness increases, the amount of truncation may have to increase and as the liner thickness decreases, the amount of truncation may have to decrease (i.e., the liner thickness and amount of truncation can be directly correlated). A fourth factor can include the outer diameter (O.D.) of the jet cutter housing. For example, as the O.D. of the housing increases, the amount of truncation may be decreased and as the O.D. of the housing decreases, the amount of truncation may be increased (i.e., the O.D. of the housing and the amount of truncation can be inversely correlated). Of course, one of ordinary skill in the art will be able to select the desired amount of truncation of the liner based on one, more than one, or all of the factors discussed.

According to one or more embodiments, the amount of truncation of the liner 103 can be selected such that a desired jet tip velocity is achieved. The desired jet tip velocity can be selected based on the type of material making up the tubing string 14 and the conditions of the well system (e.g., the wellbore fluid, whether the tubing string to be severed is located under water or under land, etc.).

The jet cutter 100 can further include a filler material 105 in the apex 104 where the liner 103 has been truncated. The filler material 105 can be any material that does not interfere with detonation or deflagration of the main explosive load 102. Examples of suitable filler materials include, but are not limited to, low-density polyurethane foam, low-density polyethylene foam, or other low-density materials that are compatible with the explosive load.

The methods include causing the main explosive load 102 to detonate or deflagrate. The step of causing can be performed after the step of positioning. The jet cutter 100 can further comprise an initiator, central booster, array of boosters, or detonation wave guide (not shown). The initiator, central booster, array of boosters, or detonation wave guide can be located adjacent to the main explosive load 102, such that the initiator, central booster, array of boosters, or detonation wave guide can detonate the main explosive load 102. The jet cutter 100 can further include a booster tube 106 and a detonation cord 107. According to one or more embodiments, the detonation cord 107 initiates the initiator, central booster, array of boosters, detonation wave guide, or the main explosive load 102, which then detonates the main explosive load. The step of causing can comprise causing initiation of the main explosive load 102. The initiation of the main explosive load 102 can include initiating the initiator, booster, booster array, or detonation wave guide.

The tubing string 14 of the well system 10 is severed due to the detonation or deflagration of the main explosive load 102. The detonation or deflagration of the main explosive load collapses the liner and creates the jet. The tubing string is severed by the jet due to the detonation or deflagration of the main explosive load. According to one or more embodiments, the detonation of the main explosive load 102 and the jet produced by the collapsed liner material 103 due to the detonation or deflagration can sever the tubing string 14 by cutting through the wall of the tubing string. The amount of truncation of the liner 103 can be selected such that the tubing string 14 is severed due to the detonation or deflagration. According to this embodiment, the jet tip velocity is increased to at least a sufficient velocity due to truncation of the liner 103 such that the tubing string 14 is severed. Of course more than one jet cutter 100 can be positioned within the tubing string 14 wherein the jet cutters can be used to sever the tubing string in multiple locations.

The methods can further comprise removing a portion of the severed tubing string 14 from the wellbore 11 or for offshore operations, from a body of water.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b,") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of severing a tubing string of a well system comprising:

positioning a jet cutter within the tubing string, wherein the jet cutter comprises:

a main explosive load, wherein upon detonation or deflagration of the main explosive load, a jet propagates radially outward in a circle from an apex of the main explosive load;

a liner comprising a first liner portion and a second liner portion, wherein the first liner portion and the second liner portion are truncated at the apex of the main explosive load such that the first liner portion and the second liner portion are not continuous; and a filler material located in the apex where the first liner portion and the second liner portion have been truncated; wherein the filler material comprises a foamed material; and causing the main explosive load to detonate or deflagrate, wherein the tubing string of the well system is severed due to the detonation or deflagration.

2. The method according to claim 1, wherein the well system is located on land or off shore.

3. The method according to claim 1, wherein the step of positioning comprises inserting the jet cutter into the tubing string.

4. The method according to claim 1, wherein the jet cutter further comprises a retainer, wherein the retainer contains the main explosive load.

5. The method according to claim 1, wherein the main explosive load comprises an explosive material, and wherein the explosive material is selected from the group consisting of: [3-Nitrooxy-2,2-bis(nitrooxymethyl)propyl] nitrate "PETN"; 1,3,5-Trinitroperhydro-1,3,5-triazine "RDX"; Octahydro-1,3,5,7-tetranitro-1,3,5,7-tetrazocine "HMX"; 1,3,5-Trinitro-2-[2-(2,4,6-trinitrophenyl)ethenyl]benzene "HNS"; 2,6-bis,bis(picrylamino)-3,5-dinitropyridine "PYX"; 1,3,5-trinitro-2,4,6-tripicrylbenzene "BRX"; 2,2',2",4,4',4",6,6',6"-nonanitro-m-terphenyl "NONA"; and combinations thereof.

6. The method according to claim 1, wherein the first liner portion and the second liner portion are positioned adjacent to the main explosive load.

7. The method according to claim 1, wherein the first liner portion and the second liner portion are truncated at the apex to remove liner elements from a path of the jet.

8. The method according to claim 7, wherein truncating the first liner portion and the second liner portion at the apex to remove the liner elements from the path of the jet increases a jet tip velocity of the jet cutter.

9. The method according to claim 1, wherein an amount of truncation of the first liner portion and the second liner portion is selected such that a specific jet tip velocity is achieved.

10. The method according to claim 1, wherein the jet cutter further comprises an initiator, central booster, array of boosters, or detonation wave guide.

11. The method according to claim 10, wherein the initiator, central booster, array of boosters, or detonation wave guide detonates the main explosive load.

12. The method according to claim 1, wherein the amount of truncation of the first liner portion and the second liner portion is selected such that the tubing string is severed.

13. The method according to claim 1, further comprising removing a portion of the severed tubing string from a wellbore or from a body of water.

14. A method of severing a tubing string of a well system comprising:

positioning a jet cutter within the tubing string, wherein the jet cutter comprises:

a main explosive load, wherein the main explosive load comprises flat surfaces that taper in at a convex angle to form an apex, and wherein upon detonation or deflagration of the main explosive load, a jet propagates radially outward in a circle from the apex;

a liner comprising a first liner portion and a second liner portion, wherein the first liner portion and the second liner portion are truncated at the apex such that the first liner portion and the second liner portion are not continuous; and a filler material located in the apex where the first liner portion and the second liner portion have been truncated; wherein the filler material comprises a foamed material;

selecting the amount of truncation of the first liner portion and the second liner portion such that a desired jet tip velocity is achieved, and wherein the desired jet tip velocity is at least sufficient to cause severance of the tubing string due to detonation or deflagration of the main explosive load, and wherein the amount of truncation is selected based on the amount of taper of the flat surfaces of the main explosive load; and causing the main explosive load to detonate or deflagrate.

15. The method according to claim 14, wherein the jet cutter further comprises a retainer, wherein the retainer contains the main explosive load.

16. The method according to claim 14, wherein the main explosive load comprises an explosive material, and wherein the explosive material is selected from the group consisting of: [3-Nitrooxy-2,2-bis(nitrooxymethyl)propyl] nitrate "PETN"; 1,3,5-Trinitroperhydro-1,3,5-triazine "RDX"; Octahydro-1,3,5,7-tetranitro-1,3,5,7-tetrazocine "HMX"; 1,3,5-Trinitro-2-[2-(2,4,6-trinitrophenyl)ethenyl]benzene "HNS"; 2,6-bis,bis(picrylamino)-3,5-dinitropyridine "PYX"; 1,3,5-trinitro-2,4,6-tripicrylbenzene "BRX"; 2,2',2",4,4',4",6,6',6"-nonanitro-m-terphenyl "NONA"; and combinations thereof.

17. The method according to claim 14, wherein the first liner portion and the second liner portion are positioned adjacent to the main explosive load.

18. The method according to claim 14, wherein the desired jet tip velocity comprises a first jet tip velocity that is greater than a second jet tip velocity of a substantially identical jet cutter without a truncated liner.

19. The method according to claim 18, wherein the increased jet tip velocity decreases an amount of swelling or flaring of the tubing string at the severance location in comparison to the swelling or flaring of the tubing string when cut with the second jet tip velocity.

20. A jet cutter comprising:

a main explosive load, wherein upon detonation or deflagration of the main explosive load, a jet propagates radially outward in a circle from an apex of the main explosive load;

a liner comprising a first liner portion and a second liner portion, wherein the first liner portion and the second liner portion are truncated at the apex such that the first liner portion and the second liner portion are not continuous, and wherein the amount of truncation is selected such that the jet has a greater tip velocity compared to a second tip velocity of a substantially identical jet cutter without a truncated liner; and a filler material located in the apex where the first liner portion and the second liner portion have been truncated; wherein the filler material comprises a foamed material.

* * * * *